United States Patent [19]

Borroni

[11] Patent Number: 4,519,197

[45] Date of Patent: May 28, 1985

[54] METHOD AND APPARATUS FOR LAYING-UP CORES OF A MULTI-CORE ELECTRIC CABLE

[75] Inventor: Andrea Borroni, Carimate, Italy

[73] Assignee: Societa Cavi Pirelli S.p.A., Milan, Italy

[21] Appl. No.: 590,731

[22] Filed: Mar. 19, 1984

[30] Foreign Application Priority Data

Mar. 24, 1983 [IT] Italy ..... 20252 A/83

[51] Int. Cl.[3] ..... D07B 3/06

[52] U.S. Cl. ..... 57/64; 57/59

[58] Field of Search ..... 57/59, 64, 65, 352, 57/116

[56] References Cited

U.S. PATENT DOCUMENTS 2,712,214 7/1955 Peterson et al. ..... 57/65
2,882,677 4/1959 Davey ..... 57/65 X
3,140,577 7/1964 Ash ..... 57/64 X
3,292,356 12/1966 Hinds ..... 57/65 X
3,382,314 5/1968 Nordblad ..... 57/59 X

*Primary Examiner*—Donald Watkins
*Attorney, Agent, or Firm*—Brooks, Haidt, Haffner & Delahunty

[57] ABSTRACT

In the laying-up of the cores of a multiple core cable in which the cores travel from a plurality of auxiliary platforms rotatably mounted on a main, rotatable platform to a laying-up member, the platforms are rotatable by separate motor drives, one for each platform, and the cores operate position sensors intermediate the auxiliary platforms and the laying-up member so as to speed up or slow down the motor drives for the auxiliary platforms dependent upon the positions of the cores as they pass from the auxiliary platforms to the laying-up member thereby eliminating residual torsion in the cores of the cable.

10 Claims, 3 Drawing Figures

METHOD AND APPARATUS FOR LAYING-UP CORES OF A MULTI-CORE ELECTRIC CABLE

The present invention concerns an improvement in the process and in the apparatus for laying-up elongated, cylindrical bodies, particularly, but not exclusively, multiple polarity electric cable cores used for conveying high voltage energy, such as multi-core cables that have to be constructed in long lengths, e.g. up to several kilometers in length, used for example, as submarine cables.

United Kingdom Pat. No. 1,043,328 teaches a process and apparatus for manufacturing multiple polarity cables which have a long length.

According to the process of said patent, each one of a plurality of cores, previously treated and impregnated and having a predetermined length, are wound, without any torsion, on an auxiliary rotatable platform. At least as many auxiliary platforms as the number of cores themselves, are carried by a main platform which is rotatable but in the direction opposite to the direction of rotation of the auxiliary platform.

Whenever it should be desired to lay up a plurality of cores together, each one is taken up from its winding on an auxiliary platform and unwound upwards in the direction of a laying up member coaxial with the axis of the main platform, the laying-up member being above the main platform, preferably, at a height above the main platform at least on the order of the diameter of the main platform itself. The operations of taking up the cores are made possible by rotating the main and the auxiliary platforms. These latter will rotate in the direction opposite to that used for producing the winding and at a rate of rotation of angular value selected so as to obtain a laying-up which is devoid of any torsion. The speed of rotation of the main platform is a function of the advancing speed of the layed-up cores.

The process and apparatus described above permits not only the laying-up together of cores made only of conductors wound with treated and impregnated insulating tapes, but also, for example, the laying-up a plurality of cores which are already contained in a metallic sheath or cores which are already clad with one or several protective layers and armored as is described in Italian Pat. No. 1,054,421.

For simplicity in description, the elongated cylindrical bodies that can be utilized with the improved process and the apparatus of the present invention, shall hereinafter be described as "cores", and such term is intended to include barecores, the conductors of which are merely clad with paper-insulation which is treated and impregnated, or else, so-clad cores placed in metallic sheaths, or clad with one or several protective layers of any material whatsoever, or armored, or single conductor cables having extruded or other insulation.

The described process and apparatus provide results which are satisfactory with regard to the taking-up and the laying-up of cores for traditional electric cables even though there is residual torsion. This residual torsion is due to the fact that each core, upon the auxiliary platform, is wound in successive, adjacent, spiral-layers which form, as a whole, a thick torus.

Since the unwinding speed of each turn of the core which is determined by the advancement of the layed-up core from the laying-up member, depends upon the radius of the turn which is unwound, it becomes clear that, with the rotation speed of the auxiliary platform remaining constant, such latter speed will be too fast for certain turns and too slow for others, and the core, which becomes detached from the coil is caused to be subjected to a small amount of torsion or residual torsion.

However, there do exist instances wherein said residual torsion could become particularly risky, and hence, not entirely tolerable. One such example is where a submarine cable is utilized as a means for laying-down optical fiber cables which are utilized in modern transmission techniques.

However, it has been found that any such residual torsion can be avoided if, during the taking-up of the core, the orientation of the separation point of the core from the winding, itself, is maintained unvaried with respect to an external fixed point.

Therefore, one object of the invention is a method and apparatus which allows for obtaining multiple polarity cables wherein the cores, which are layed-up with one another, are completely devoid of any torsion.

More precisely, the object of the present invention is an improved process for laying-up a plurality of cores, especially, but not exclusively, the cores for electrical multiple polarity submarine cables, comprising providing a winding, without torsion, of each of the said cores which is to be layed-up, each core having been previously manufactured in the lengths desired. Each winding is formed on a corresponding auxiliary platform which is rotatable about its own vertical axis. A plurality of auxiliary platforms are mounted on a main platform which rotates in the direction opposite to the direction of rotation of the auxiliary platforms. As each core is lifted-out from its respective winding, starting from the separation-point, it is guided towards a laying-up position where it is layed-up with the other cores of the plurality. The process is characterized by the fact that the orientation of said separation-point, is predetermined with respect to an outside point, and that said orientation is maintained constant for the entire duration of the lifting-out phase of the cores.

In a preferred embodiment, said improved process is characterized by the fact that the constancy of the orientation is maintained by having an instantaneous control of the rotation speed of the auxiliary platform with each deviation of the separation-point from its pre-established orientation.

In addition, the invention relates to apparatus for performing the process described hereinbefore. Said apparatus comprises at least one main platform rotatable about its own vertical axis and carrying a plurality of auxiliary platforms, each rotatable about its own vertical axis in the direction opposite to that of the main platform. Each main and auxiliary platform is provided with an independent motor drive. A laying-up member is disposed with its own axis coincident with the axis of said main platform and placed above the latter. The apparatus is characterized by the fact of being provided with a sensor for each auxiliary platform which senses any deviation of said separation-point from its pre-establihsed orientation and generates a signal directed to the input-feed fo the associated motor drive for controlling the rotation speed of the corresponding auxiliary platform.

In one embodiment, said sensor is a means apt for converting a mechanical motion into an electrical signal.

In a preferred embodiment, said last-mentioned means is a potentiometer, connected to the input-feed of the motor drive of the corresponding platform and having its movable arm operable by a rotating element oriented in the same way as said separation point and mounted, in cantilever fashion, above said auxiliary platform, on a shaft that is coaxial to the auxiliary platform. The shaft passes through a central aperture provided in the auxiliary platform itself and is mounted from said main platform permitting it to rotate 360° around itself during each complete rotation of said main platform, but in the opposite sense.

In a preferred embodiment, said rotating element is a fork, disposed astride a pre-fixed transit zone for the core during its path from the separation-point towards the laying-up member. The fork is pivotable on its own shaft and can oscillate in the horizontal plane by an angle between 20° and 60°.

Other objects and advantages of the present invention will be apparent from the following detailed description of the presently preferred embodiments thereof, which description should be considered in conjunction with the accompanying drawings in which.

Figure 1:
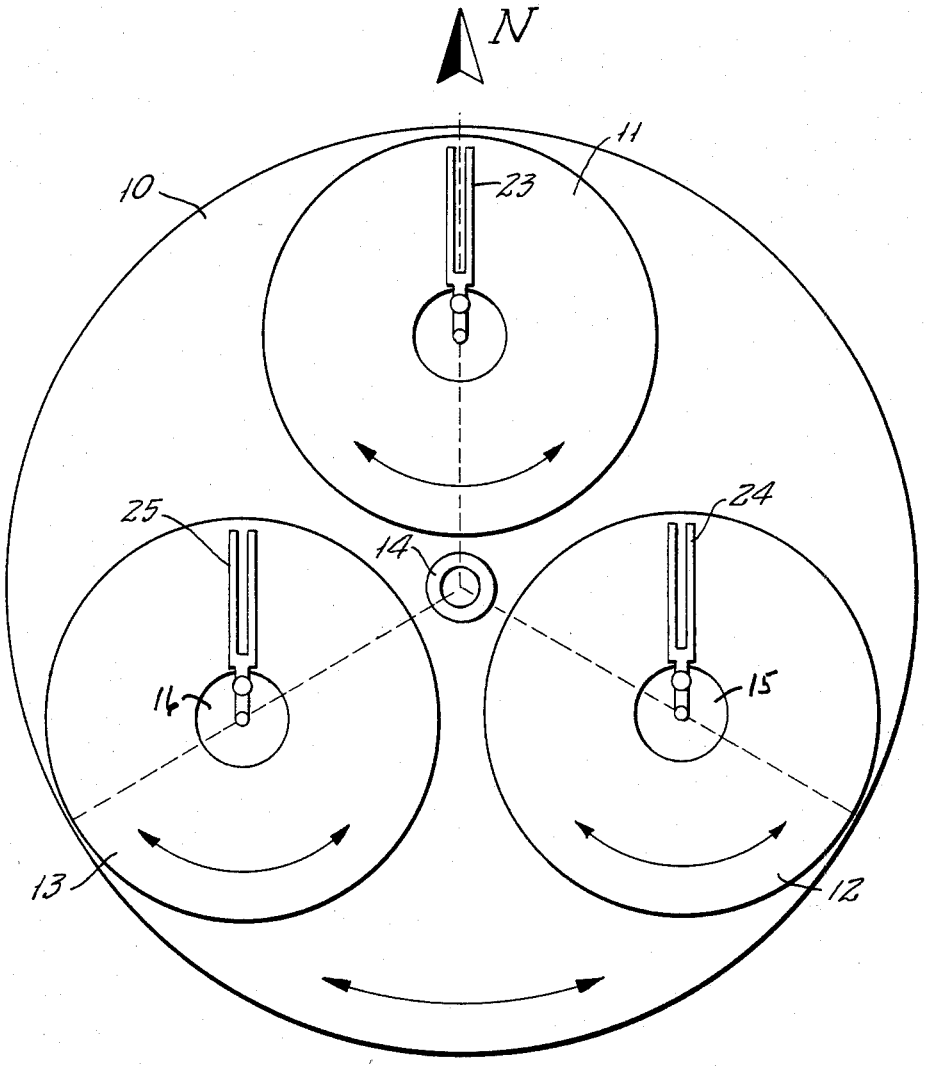
FIG. 1 is a schematic, plan-view of a preferred embodiment of the apparatus of the invention.

In FIG. 1, there is shown apparatus for laying-up a multiple polarity cable, and the apparatus comprises a main platform 10, three auxiliary platforms 11, 12, 13 supported by said main platform 10, and a laying-up member 14.

The apparatus is intended for the laying-up of a three core cable, and therefore, the auxiliary platforms are three in number. Should, however, the elongated bodies, or the cores, to be layed-up be different in number, for example, more than three, as may be the case because it is desired to lay-up, with power-cable cores, an elongated body which is an optical fiber cable, the auxiliary platforms will be of a number that is equal to the number of elongated bodies to be layed-up.

The main platform 10 is rotatable about its own vertical axis.

Above the main platform 10, coaxial with the latter and at a height which, preferably, is at least on the order of the diameter of the main platform 10, there is provided a laying-up member 14.

Figure 2:
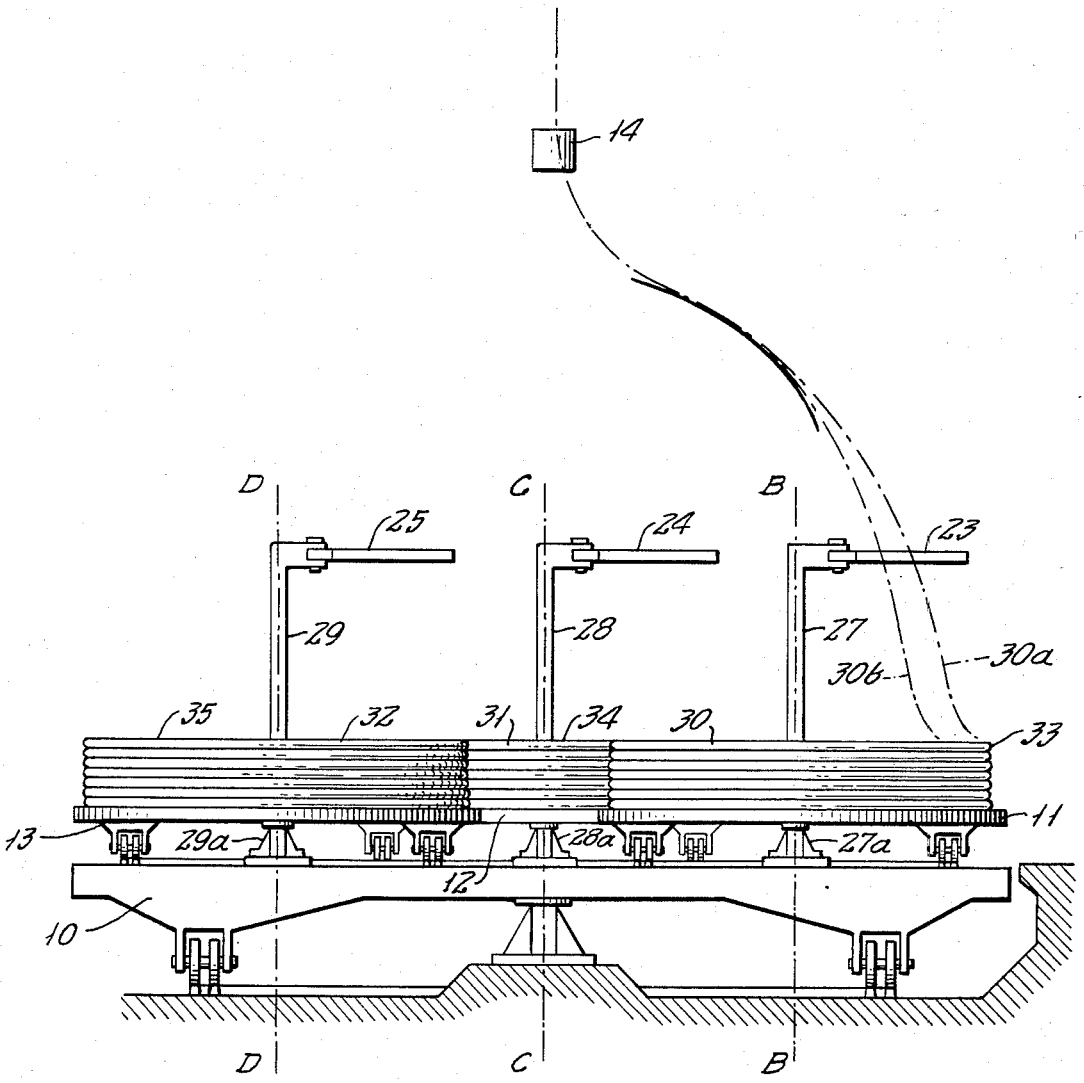
FIG. 2 is an elevation-view of the apparatus shown in FIG. 1.

The auxiliary platforms 11, 12 and 13 are rotatably mounted on the main platform 10 and are rotatable about their respective vertical axes B—B, C—C, D—D (FIG. 2), all in the same direction, but in the opposite sense to the rotation of the main platform 10.

Figure 3:
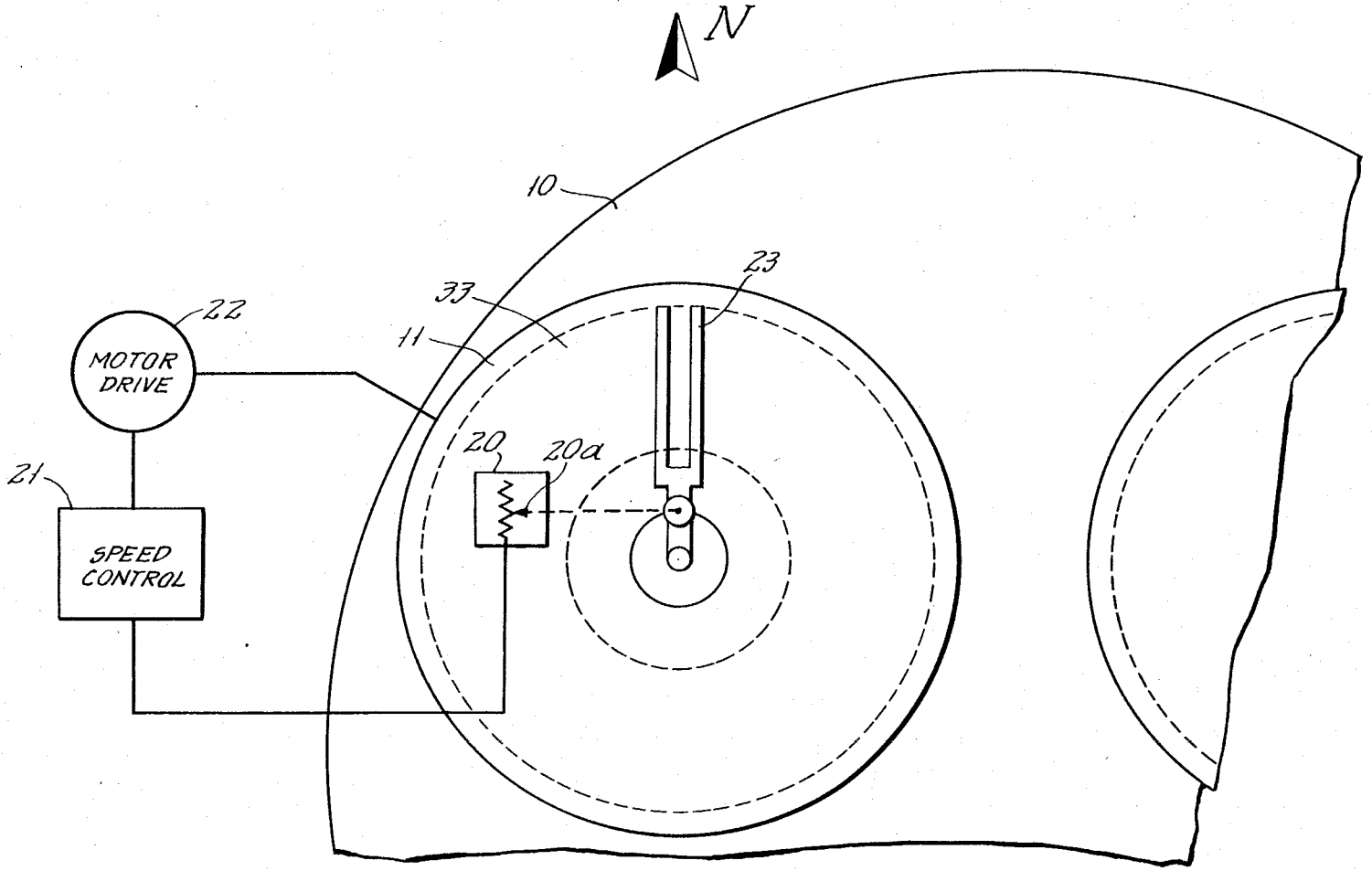
FIG. 3 is a schematic, fragmentary, enlarged plan view of the embodiment shown in FIGS. 1 and 2 with the devices for controlling the speed of one auxiliary platform being shown diagramatically.

The main platform 10 and the auxiliary platforms 11, 12 and 13 are provided with independent motor drives, only one of which is illustrated by the motor 22, with its related input-feed speed control 21, for the platform 11 (see FIG. 3). In fact, the three auxiliary platforms 11–13 must be able to rotate even when the main platform 10 is stationary and independently of one another, for example, at the start of the operation for the winding of each core on its corresponding auxiliary platform.

Each auxiliary platform 11, 12 and 13 is provided with a sensor, and said sensor is, preferably, a means for converting a mechanical movement into an electrical signal. In the embodiment illustrated, the sensors are constituted by potentiometers, only one of which, the potentiometer 20, is illustrated (see FIG. 3) in connection with the platform 11, the potentiometer 20 being connected to the input-feed, speed control 21 of the motor drive 22. In a manner known to those skilled in the art, the potentiometer 20 forms part of a speed control 21 which controls the speed of the motor drive 22, and the speed at which the motor drive 22 rotates the auxiliary platform 11 depends upon the position of the movable arm 20*a* of the potentiometer 20.

The drive elements 23, 24 and 25 for each potentiometer are pivotably mounted above the respective auxiliary platforms 11, 12 and 13 in cantilever fashion on shafts 27, 28 and 29 and with their pivot axes parallel with the latter.

Each shaft 27, 28 and 29 passes through a central aperture 14, 15 and 16, in the respective auxiliary platforms 11, 12 and 13 and is mounted on said main platform 10, by a known type of mechanical device, 27*a*, 28*a* and 29*a*, which permits each shaft 27, 28 and 29 to rotate through 360° during each complete rotation of the main platform 10, rotating, however, in direction opposite to the direction of rotation of the main plaftorm 10. The devices 27*a*–29*a* allow the shafts 27–29 to maintain a constant orientation with respect to a fixed point outside the main platform 10 as the main platform 10 and the auxiliary platforms 11–13 are rotated.

Accordingly, the drive elements 23, 24 and 25 are oriented in a constant manner unless they are pivoted by a core associated therewith and being taken-off from an auxiliary platform. The sensing zone of each drive element 23–25 is, therefore, oriented in a fixed direction as the platforms are rotated. In the apparatus which is illustrated in FIG. 1, all the potentiometer drive elements 23, 24 and 25, are oriented to the north, but, of course, they could also have a different orientation from that indicated, and also different from each other, provided that their orientation remains constant as the platforms are rotated.

The drive elements 23, 24 and 25, can be, for example, a fork which is pivotable with respect to the shaft 27, 28 or 29, respectively. Thus, each fork can oscillate about its pivot point, and the angle of oscillation in the horizontal plane, could have an amplitude of between 20° and 60°, but, preferably, it is of about 44° (±22°). Each fork is disposed astride a prefixed zone for the transit of the core as it is lifted-off from the corresponding platform in its passage from the separation-point at an auxiliary platform and moves toward the laying-up member 14.

Let it be assumed that three cores 30, 31 and 32, must be layed-up together, for forming a multipolar cable. A coil or winding 33, 34 and 35, without torsion, is formed on the respective platforms 11, 12 and 13 of each core, each core having been previously manufactured in the length desired. The term "winding" is intended to mean the disposition of the core in successive layers of adjacent turns, which, in effect, form, in their assembly, a solid having a toroidal form.

Whenever the forward-head, (the term "forward-head" is intended to mean the head which remains at the top of the winding) of each core, at the completion of the winding 33, 34 and 35, should be oriented position different from that of the fork 23, 24 or 25, or else, in the example, different from north, provision is made, through the rotation of the auxiliary platforms 11, 12 or 13, for its orientation, in the manner desired. In this manner, the orientation is pre-established, with respect to an outside fixed point, of the separation-point of the core from the related winding.

For proceeding with the laying-up of the three cores 30, 31 and 32, the cores are withdrawn simultaneously upwards, in the direction of the laying-up member 14, starting from said pre-established separation-point, while causing the auxiliary platforms 11, 12 and 13 to rotate, in a direction opposite to the direction which brought about the winding and while rotating the main platform 10 in the direction opposite to the direction of rotation of the auxiliary platforms 11, 12 and 13, at a speed which takes into account the advancing speed of the layed-up cable and of the stranding pitch.

During its passage towards the laying-up member 14, each of the cores 30, 31 and 32, passes into the sensing zone of the forks 23, 24 and 25, respectively, corresponding to the auxiliary platforms 11, 12 and 13 from which the core is respectively taken up.

For the sake of simplicity, only the operation during the taking-up of the single core 30 coming from the winding 33 disposed on the platform 11 will be described. The operation for the taking-up of the cores 31 and 32 from the remaining windings 34 and 35 on the platforms 12 and 13 is the same.

The core 30, taken upwards, starting from a pre-established separation-point oriented towards the north, as stated above, and which corresponds to the separation-point of the forward-head of the upper turn, passes in its passage towards the laying-up member 14 through the sensing zone of the fork 23 which is set, if not already set, to enclose a zone for the transit of the core 30 during the taking-up operation. With the speed of the auxiliary platform being constant, all the sections of the core 30 which belong to the same turn will not have their own separation-points oriented towards north.

With our invention, this drawback is obviated, because when the separation-point of the core 30 deviates in orientation with respect to the original one, i.e. diverse from north in the example, the core 30 will engage an arm of the fork 23 and cause shifting of it through an angle with respect to the northward direction.

The potentiometer 20, therefore, evaluates the deviation of the core 30 and provides an electrical signal which it sends to the input-feed speed control 21, and which is of such a magnitude and sense as to control the motor drive 22 to cause speeding-up or slowing down of the platform 11. For example, if the platform 11 is rotating clockwise, as viewed in FIG. 3, and if the fork 23 is also moved clockwise, indicating that the core length is too much, the motor drive 22 slows down and slows down the rotation speed of the platform 11. Conversely, if the fork 23 is moved counter-clockwise, indicating that the core length is too short, the motor drive 22 speeds up with an accompanying increase in the speed of rotation of the platform 11. The core 30 is thus shifted toward north. Accordingly, the pre-established separation-point can be restored at each deviation and remains practically constant for the entire duration of the taking-up of the core 30.

It is apparent that the process and apparatus of the invention are not only useful for conforming the rotation speeds of the auxiliary platform to take account of the passage from one turn to the next but they are also effective whenever the speed of the auxiliary platform should, either through human error or due to unforeseen circumstances, not correspond with the optimum speed for the spiral winding involved in the taking-up.

Although preferred embodiments of the present invention have been described and illustrated, it will be apparent to those skilled in the art that various modifications may be made without deparing from the principles of the invention.

The embodiments of the invention in which an exclusive property or privilege is claimed are defined as follows:

1. A process for the laying-up of a plurality of elongated cylindrical bodies without significant torsion thereon after they have been layed-up, said process comprising:

providing a plurality of windings of said bodies, one winding for each body and the body of each winding being substantially free of torsion;

removing each body from its winding and supplying each of said bodies to a laying-up member while rotating said windings in a first direction and rotating said windings, as a group, around an axis common to the group, in a second direction opposite to said first direction; and maintaining the orientation of the point of separation of each body from its winding substantially constant with respect to a fixed point as the bodies are removed from their respective windings.

2. A process as set forth in claim 1 wherein the orientation of the point of separation is maintained constant by adjusting the position of the body intermediate its winding and the laying-up member.

3. A process as set forth in claim 1 wherein said elongated cylindrical bodies are cores including an electromagnetic energy conductor and wherein the orientation of the point of separation is maintained substantially constant by adjusting the speed of rotation of the winding from which a core is being separated.

4. Apparatus for laying-up a plurality of elongated cylindrical bodies comprising:

a rotatable main platform;

first motor means connected to said main platform for rotating said main platform;

a plurality of auxiliary platforms rotatably mounted on said main platform with their axes of rotation spaced from and generally parallel to, the axis of rotation of said main platform;

second motor means, one for each of said plurality of auxiliary platforms connected to said auxiliary platforms for rotating said auxiliary platforms in a direction opposite to the direction of rotation of said main platform;

a laying-up member spaced from said main platform and substantially aligned with said axis of said main platform;

a plurality of speed control means, one for each of said second motor means, for controlling the speed of rotation of the auxiliary platform to which the second motor means is connected; and a plurality of position sensing means, one for each speed control means, connected to respective ones of said speed control means and intermediate, respectively, an auxiliary platform and said laying-up member for engaging the cylindrical body passing between an auxiliary platform and said laying-up member and varying the speed control means to which it is connected dependent upon the position of the cylindrical body engaged thereby.

5. Apparatus as set forth in claim 4 wherein each of said speed control means is variable by an electrical signal and wherein said position sensing means comprises means for providing an electrical signal dependent upon the position of the cylindrical body.

6. Apparatus as set forth in claim 5 wherein each of said means for providing an electrical signal comprises a resistor having varying means for varying the effective resistance thereof, a shaft mounted coaxially with the respective auxiliary platform and rotatably mounted on said main platform, and drive means pivotally mounted on said shaft and connected to said varying means, said drive means being engageable with the cylindrical body passing between an auxiliary platform and said laying-up member.

7. Apparatus as set forth in claim 6 wherein said resistor is a potentiometer and said varying means is the arm of said potentiometer.

8. Apparatus as set forth in claim 6 wherein said drive means is a fork for receiving a cylindrical body between the fingers thereof.

9. Apparatus as set forth in claim 7 wherein said drive means is a fork for receiving a cylindrical body between the fingers thereof.

10. Apparatus as set forth in claim 8 wherein said fork is pivotable between 20° and 60° around its pivot axis.

* * * * *